US006814055B2

(12) United States Patent
Kihlberg et al.

(10) Patent No.: US 6,814,055 B2
(45) Date of Patent: Nov. 9, 2004

(54) MAGNETIC IGNITION SYSTEM

(75) Inventors: Johan Kihlberg, Bengtsfors (SE); Lars-Olof Ottosson, Tösse (SE)

(73) Assignee: Sem AB, Amal (SE)

( * ) Notice: Subject to any disclaimer, the term of this patent is extended or adjusted under 35 U.S.C. 154(b) by 91 days.

(21) Appl. No.: 10/220,410

(22) PCT Filed: Mar. 7, 2001

(86) PCT No.: PCT/SE01/00481

§ 371 (c)(1),
(2), (4) Date: Nov. 12, 2002

(87) PCT Pub. No.: WO01/66936

PCT Pub. Date: Sep. 13, 2001

(65) Prior Publication Data

US 2003/0145828 A1 Aug. 7, 2003

(30) Foreign Application Priority Data

Mar. 8, 2000 (SE) ..... 0000766

(51) Int. Cl.[7] ..... F02P 5/00; F02P 1/08

(52) U.S. Cl. ..... 123/406.57; 123/149 D; 123/631

(58) Field of Search ..... 123/406.57, 406.56, 123/149 D, 631, 41 E; 324/381, 382, 391

(56) References Cited

U.S. PATENT DOCUMENTS 4,566,425 A 1/1986 Nitou et al.
4,611,570 A 9/1986 Nash
4,643,150 A 2/1987 Miura et al.
5,111,798 A * 5/1992 Notaras et al. ..... 123/637
5,161,489 A * 11/1992 Morooka ..... 123/41 E
6,020,742 A 2/2000 Kano et al.
6,405,687 B1 * 6/2002 Arakawa et al. ..... 123/41 E
6,474,273 B1 * 11/2002 Kinoshita et al. ..... 123/41 E

FOREIGN PATENT DOCUMENTS

DE 197 20 532 A1 1/1999
WO WO 97/08642 A1 3/1997

* cited by examiner

*Primary Examiner*—Hai Huynh
(74) *Attorney, Agent, or Firm*—Ware, Fressola, Van Der Sluys & Adolphson LLP

(57) ABSTRACT

A circuit to achieve a large ignition advance, limitation of speed of revolutions and to prevent backfiring and reverse direction running in a magnetic ignition system that comprises a flywheel with two poles and a two-legged iron core. An ignition transformer (L3/L4), a charging coil (L1) and a triggering coil (L2) that may be connected in antiphase to the charging coil are arranged on the first leg in the direction of rotation of the flywheel. A time-constant circuit (an RC net) and a control switch (T2) are arranged between the charging coil and a main switch (T1) that open/block triggering pulses such that charging takes place one revolution later than triggering. Limitation of the speed of revolutions is achieved with a time constant that can be determined.

4 Claims, 3 Drawing Sheets

MAGNETIC IGNITION SYSTEM

BACKGROUND OF THE INVENTION

1. Technical Field

The present invention concerns a circuit for achieving large ignition advance, limitation of the speed of revolutions, and for preventing backfiring in a magnetic ignition system comprising a flywheel and a two-legged iron core.

2. Description of the Related Art

For reasons of safety, the motor in a motor saw or similar device must not rotate in the wrong direction since this means that the saw chain also rotates in the wrong direction, leading to the risk of personal injury. If the fuel/air mixture in the motor is significantly ignited before the piston reaches its turning point when trying to start the motor, the motor can start to rotate backwards, since its kinetic energy is low during start, which means that the piston can be pressed downwards in the wrong direction of rotation. Such a process in a motor is known as "backfiring". In certain conditions, the motor can also reverse its direction of rotation during operation, which is known as "reverse direction running". The risk for personal injury must be eliminated if the motor starts in the wrong direction.

In order to prevent backfiring, it is desired to ignite the mixture close to the upper turning point of the piston (top dead centre) when running at low speeds of rotation, since the kinetic energy of the motor is then low, this is known as "low ignition advance". On the other hand, at high speed of revolutions, it is desired to ignite the mixture earlier, since this extracts more power from the motor. This is known as using a "high ignition advance".

An ignition system with a large ignition advance (a large difference between the time of ignition at low speed and the time of ignition at high speed) thus makes it possible to reduce the risk of backfiring at low speed at the same time as making it possible to extract a great deal of power from the motor at high speed. However, this is difficult to achieve with one module that does not have a large ignition advance, since such a module is normally adjusted to an ignition position that is a compromise between starting ignition and ignition for high speed.

SUMMARY OF THE INVENTION

The present invention concerns a circuit for achieving large ignition advance, limitation of the rate of revolutions in both directions of rotation, and for preventing backfiring and reverse direction running of a motor.

The circuit on which the invention is based concerns a magnetic ignition circuit that comprises a flywheel and a two-legged iron core. An ignition transformer, a charging coil for generating a charging pulse for a charging circuit and a triggering coil that is connected in antiphase to the charging coil are arranged on the first leg of the iron core in the direction of rotation of the flywheel. The triggering coil generates, to a main switch, a triggering pulse before the charging pulse and a triggering pulse after the charging pulse. Such a magnetic ignition system has a very small ignition advance. The reason for this is that the different coils interfere with each other, which means that time displacements that arise in one coil are coupled to the other coils. This gives rise to the ignition at higher speeds of revolutions (frequencies) tending to occur later, something that in most cases is a disadvantage for the performance of the motor.

The invention, which is intended to solve these problems, is characterised by a time-constant circuit, in this case an RC net, that is connected between the charging circuit and the main switch. Such a net is previously known and is often used as an excess speed protection. According to the present application, however, the time-constant circuit controls a control switch that opens/blocks triggering pulses to the main switch, whereby the net can be used for limiting the speed of revolutions, in order to achieve safety from reverse direction running and to achieve large ignition advance in a cost-efficient manner without the ignition system becoming unnecessarily large and clumsy.

Other characteristics of the invention are specified in the accompanying claims.

BRIEF DESCRIPTION OF THE DRAWINGS

In the following text, reference will be made to the attached drawings for a better understanding of the described embodiments and examples of the present invention, in which.

DETAILED DESCRIPTION OF THE INVENTION

Figure 1:
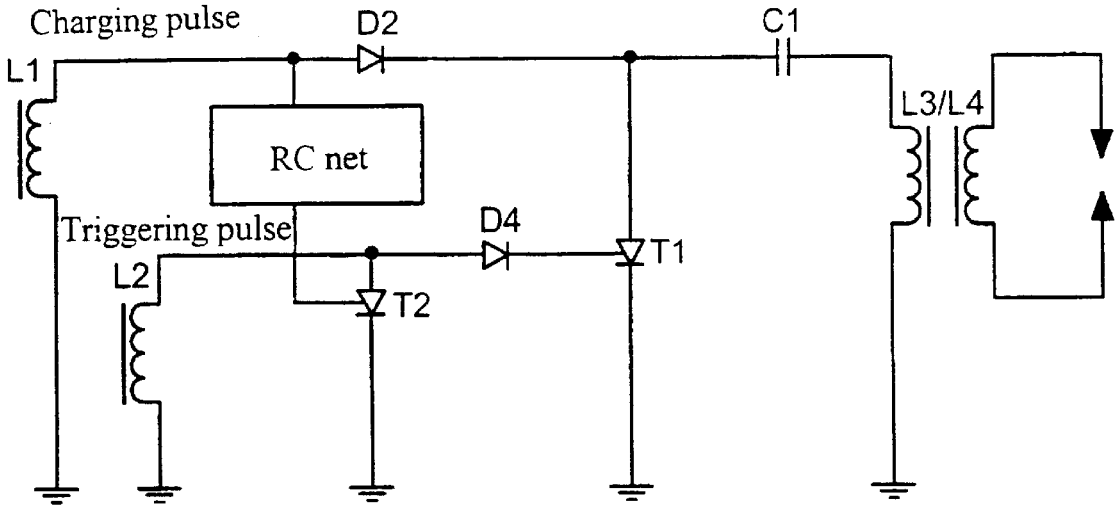
FIG. 1 shows a sketch of the principle of the circuit according to the present invention.

The circuit according to the invention to achieve a large ignition advance, limitation of the speed of revolutions and for prevention of backfiring in a magnetic ignition system comprises a flywheel and a two-legged iron core. It is preferable that the flywheel has two magnetic poles. A charging coil L1 (see FIG. 1) is arranged on the first leg of the iron core in the direction of rotation of the flywheel in order to generate a charging pulse for a charging circuit comprising a diode D2 and a charging condenser C1. Furthermore, a triggering coil L2 is arranged on the same leg of the core in order to generate a triggering pulse for a main switch, which in the case shown is a thyristor T1, via a diode D4. An ignition transformer L3/L4 is also arranged on the said leg of the core. A time-constant circuit, which in the case shown is an RC net (R1, C2), is connected between the charging circuit and the triggering circuit via a diode D3. This time-constant circuit controls a control switch, which in the case shown is a thyristor T2, which opens/blocks the triggering pulse to the main switch T1.

A magnetic ignition system in general functions as follows. A flywheel rotates in a magnetic ignition system and induces in a charging coil a potential to a charging condenser. A potential, that is, triggering pulses, is induced in a triggering coil, to a control electrode of a main switch, whereby this main switch opens. When this occurs, the main switch discharges the potential from the charging condenser to an ignition transformer, whereby a spark is generated at the high-tension output of the ignition transformer.

The device according to the invention concerns a magnetic ignition system that comprises a two-legged iron core, on the first leg of which is arranged a charging coil L1 and a triggering coil L2 that is connected in antiphase to the charging coil. It is preferable that the flywheel has two magnetic poles. During normal operation, see FIG. 2, the main pulse from the charging coil L1 is used to charge the charging condenser C1 since this pulse contains the most energy and a more powerful spark is obtained. The triggering coil L2 can be wound in antiphase to the charging coil L1, which means that the triggering coil gives rise to two induced potentials, that is, to two triggering pulses, to the main switch T1. One triggering pulse lies in front of the charging pulse (triggering pulse 1) and one triggering pulse lies after the charging pulse (triggering pulse 2).

Figure 2:
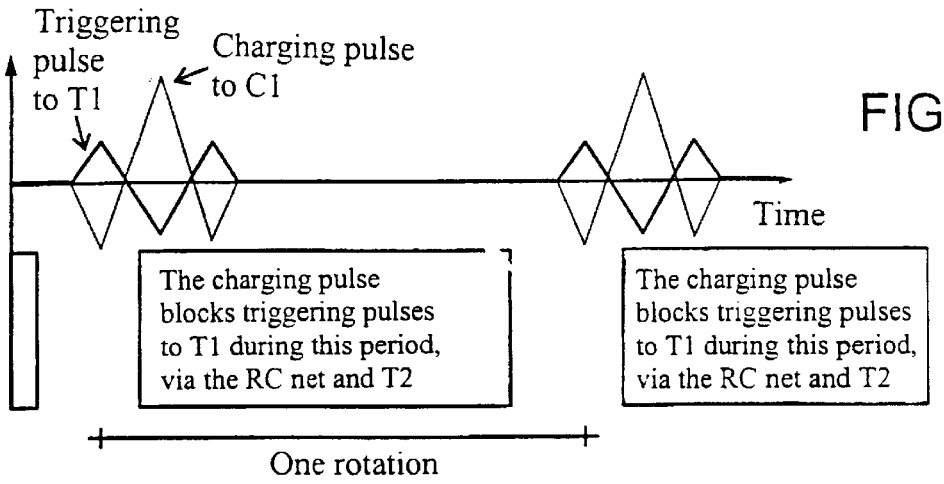
FIG. 2 shows a pulse diagram for rotation in the forward direction during normal operation.

During rotation in the forward direction, shown in the pulse diagram according to FIG. 2, the first induced potential of the triggering coil L2 will arise before the charging condenser C1 has been charged, which means that no spark is generated. After this, the charging coil L1 will induce a potential that is stored in the charging condenser C1, and shortly thereafter the second induced potential from the triggering coil L2 will arrive, which brings about triggering such that the stored charge in the charging condenser is discharged, which gives rise to a spark.

However, according to the present invention, triggering takes place on triggering pulse 1. This is achieved through the RC net, which has a time constant that can be determined. This RC net controls a control switch T2. When the control switch T2 conducts, the triggering pulse will be led through it instead of being led to the main switch T1. The following events must take place in the correct order in order for a spark to be obtained:

1) The condenser C1 is charged by a charging pulse, and

2) The thyristor T1 is opened by a triggering pulse, which ensures that the condenser C1 is discharged through the ignition transformer L3/L4.

According to the invention, the control switch T2 is held open as long as triggering pulse 2 is blocked which is why main switch T1 does not receive a control pulse until the first triggering pulse of the next revolution occurs. This means that charging of the charging condenser C1 occurs one revolution earlier than the triggering, and a large ignition advance is achieved. See FIG. 2.

When the speed of revolutions increases, the time at which the maximum amplitude of the charging coil is achieved will be displaced in time due to the capacitance and inductance in the charging circuit. This gives rise to a displacement in time also of the signal of the triggering coil, and in turn achieves a later ignition.

As has been described above, a large ignition advance is brought about through the blocking of the second triggering pulse by the RC net and control switch, such that ignition takes place on the first triggering pulse of the subsequent revolution. This means that charging of the charging condenser C1 takes place one revolution earlier than the triggering. This means that there is no influence from the charging process and thus there will be no unfavourable displacement in time of the signal of the triggering coil at high speeds of revolutions.

Figure 3:
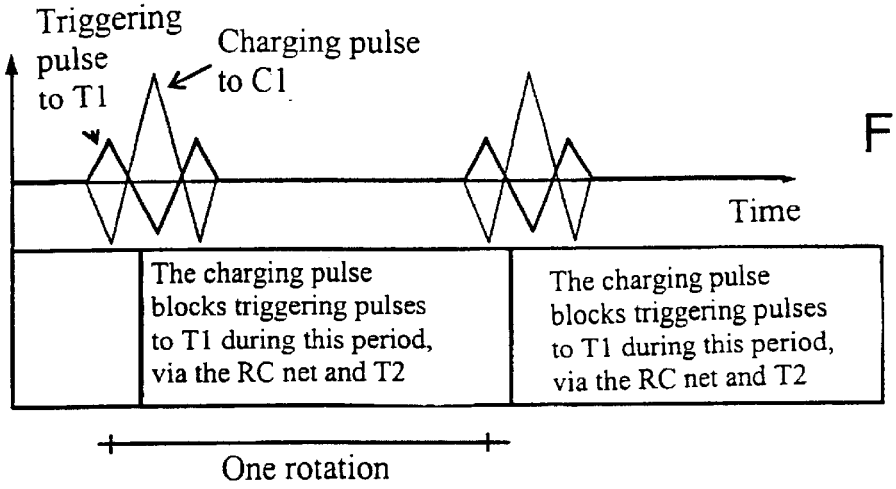
FIG. 3 shows a pulse diagram for rotation in the forward direction when the speed of revolutions is limited.

Limitation of the speed of revolutions is achieved in that the time constant circuit RC with the control switch T2 is arranged to block triggering pulses to the main switch T1 for a certain period following each charging pulse. If the triggering pulse occurs sufficiently closely in time to the charging pulse of the previous revolution, the control switch T2 will still be in a conducting state and the triggering pulse will be led through this switch. Thus the main switch T1 will not receive a control pulse which means that the condenser is not discharged, and thus that the motor does not receive a spark. Thus the speed of revolutions is regulated by adjustment of the time constant. See FIG. 3.

The same circuit is used to limit the speed of revolutions in both the forward and the backward directions.

Figure 4:
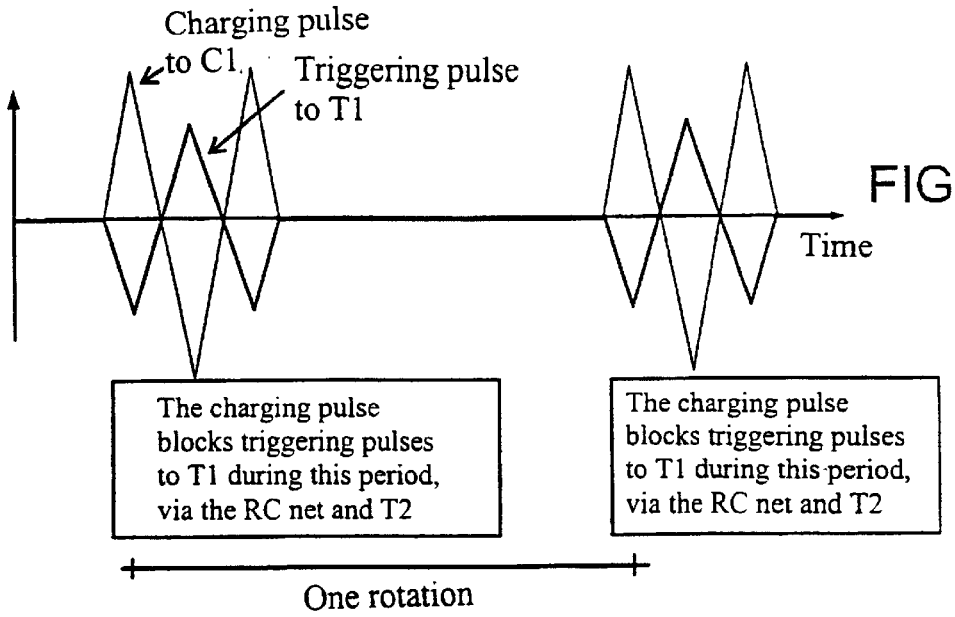

During rotation in the backward direction, see FIG. 4, the charging pulse received two positive pulses and the triggering pulse one positive pulse that occurs immediately after the first positive pulse of the charging pulse since the pulses occur in the reverse order. The control switch T2 will be opened by the first charging pulse and the triggering pulse that is induced in the triggering coil L2 will pass through the control switch T2 instead of through the control electrode of the main switch T1. Thus the main switch T1 does not receive a control voltage and no spark can occur.

A certain function may be present at low speeds of revolutions. It is important to prevent personal injury, and thus the limitation of speed during reverse direction running must start before the centrifugal coupling that connects the motor with the saw chain is activated. Typically, this occurs at 3,000 rpm.

Figure 5:
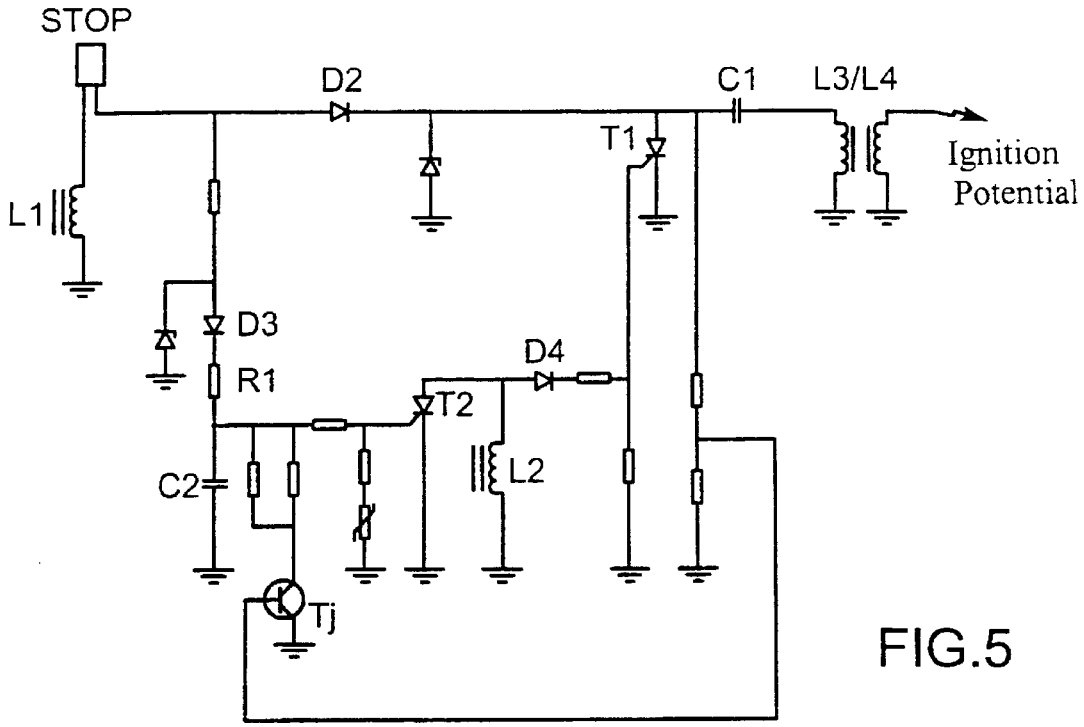
FIG. 5 shows a connection diagram for a circuit according to the invention, where only the components that are most important for the invention have been given reference symbols.

The time constant that is required to remove the second triggering pulse at low speeds of revolutions may be too large for the RC net to function as a limitation of the speed of revolutions, that is, it occurs at a speed that is too low. In order to solve this problem, a transistor TJ is connected, according to one embodiment of the invention, to the RC net, see FIG. 5. The transistor TJ receives its control potential from the charging circuit and only starts to conduct when the potential in the charging circuit has reached a certain level. By changing the time constant of the RC net, the circuit can be used to achieve limitation of the speed of revolutions.

Figure 6:
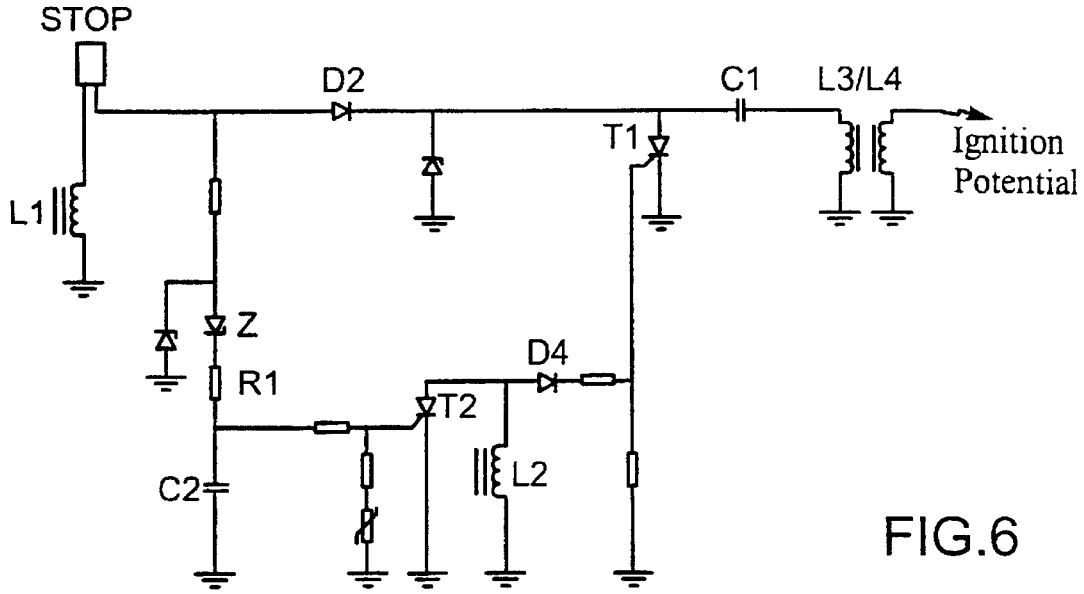
FIG. 6 shows a circuit diagram according to an alternative circuit according to the invention.

Alternatively, the time, during which the control switch T2 remains open after the charging pulse, can be influenced by the amplitude of the potential in the condenser C2. If the diode D3 is replaced by a Zener diode Z, see FIG. 6, a large time constant can be used without the activation of T2 occurring at the correct triggering pulse (in the forward direction) at too low a speed of revolutions. This depends on the potential in C2 being discharged, to a certain value before the arrival of the correct triggering pulse, by the negative charging pulse. However, the value of the Zener diode Z is chosen such that it gives a short-circuiting of the control switch T2 (when the correct triggering pulse occurs) over the limiting value of the speed of revolutions (excess speed protection).

The function and the construction of the present invention are assumed to be made clear by the description given. Even if the embodiments that have been described have been preferred, it is evident that modifications can be made within the framework of the scope that is defined in the accompanying claims.

What is claimed is:

1. A circuit to achieve large ignition advance, limitation of speed of revolutions and to prevent backfiring and reverse direction running in a magnetic ignition system comprising a flywheel and a two-legged iron core, on the first leg of which in the direction of rotation of the flywheel are arranged an ignition transformer, a charging coil in order to generate a charging pulse to a charging circuit and a triggering coil that generates a triggering pulse before and a triggering pulse after the charging pulse to a main switch, characterised in that the circuit comprises a time-constant circuit that controls a control switch which opens/blocks the triggering pulse and is connected between the charging circuit and the main switch, which time-constant circuit and control switch are arranged such that the charging pulse blocks the second triggering pulse such that triggering takes place on the first triggering pulse of the next revolution in order to achieve ignition advance, whereby limitation of the speed of revolutions occurs by means of adjustment of the time-constant circuit and that reverse direction running is prevented in that the charging pulse is arrange to block the subsequent triggering pulse via the time-constant circuit and the control switch.

2. The circuit according to claim 1, characterised in that the circuit comprises a switch that is connected to the time-constant circuit such that the control voltage of the switch is provided by the charging circuit whereby the switch is arranged to start to conduct when the potential in the charging circuit has reached a certain level.

3. The circuit according to claim 2, characterised in that the flywheel has two magnetic poles.

4. The circuit according to claim 1, characterized in that the flywheel has two magnetic poles.

* * * * *

UNITED STATES PATENT AND TRADEMARK OFFICE

CERTIFICATE OF CORRECTION

PATENT NO. : 6,814,055 B2
DATED : November 9, 2004
INVENTOR(S) : Kihlberg et al.

It is certified that error appears in the above-identified patent and that said Letters Patent is hereby corrected as shown below:

Column 2,
After line 27, -- Fig. 4 shows a pulse diagram for rotation in the reverse direction; -- should be inserted.

Column 5,
Line 7, "arrange" should be -- arranged --.

Signed and Sealed this

Twenty-third Day of August, 2005

JON W. DUDAS
*Director of the United States Patent and Trademark Office*